US007651421B2

(12) United States Patent
Smith et al.

(10) Patent No.: US 7,651,421 B2
(45) Date of Patent: Jan. 26, 2010

(54) ARROW INSERT APPARATUS

(75) Inventors: Jacob C. Smith, Salt Lake City, UT (US); Kenny R. Giles, West Valley City, UT (US); Teddy D. Palomaki, Park City, UT (US)

(73) Assignee: Jas. D. Easton, Inc., Van Nuys, CA (US)

( * ) Notice: Subject to any disclaimer, the term of this patent is extended or adjusted under 35 U.S.C. 154(b) by 207 days.

(21) Appl. No.: 11/247,753

(22) Filed: Oct. 11, 2005

(65) Prior Publication Data

US 2007/0082767 A1 Apr. 12, 2007

(51) Int. Cl.
*F42B 6/04* (2006.01)

(52) U.S. Cl. ..... 473/582

(58) Field of Classification Search ..... 473/578, 473/582, 583, 584; 604/218, 228; 215/355, 215/358, 362, 364; D7/524, 537
See application file for complete search history.

(56) References Cited

U.S. PATENT DOCUMENTS

| | | | | | |
|---|---|---|---|---|---|
| D90,928 | S | * | 10/1933 | Rosenmerkle | D7/524 |
| D93,120 | S | * | 8/1934 | Mann | D7/524 |
| 2,746,632 | A | * | 5/1956 | Bramming | 215/270 |
| 3,057,502 | A | * | 10/1962 | Wood | 215/355 |
| 3,277,893 | A | | 10/1966 | Clark | |
| 3,401,938 | A | | 9/1968 | Bear | |
| 4,203,601 | A | | 5/1980 | Simo | |
| 4,533,146 | A | | 8/1985 | Schaar | |
| 4,534,568 | A | * | 8/1985 | Tone | 473/583 |
| 4,671,517 | A | * | 6/1987 | Winters | 473/583 |
| 4,706,965 | A | | 11/1987 | Schaar | |
| 4,943,067 | A | * | 7/1990 | Saunders | 473/578 |
| 4,944,723 | A | * | 7/1990 | Haber et al. | 604/110 |
| 5,035,764 | A | | 7/1991 | Blake | |
| 5,090,149 | A | | 2/1992 | Young | |
| 5,242,720 | A | | 9/1993 | Blake | |
| 5,273,293 | A | | 12/1993 | Lekavich | |
| 5,465,979 | A | | 11/1995 | Buhler | |
| 5,496,042 | A | | 3/1996 | Craft et al. | |
| 5,516,117 | A | | 5/1996 | Rangel | |
| 5,902,199 | A | | 5/1999 | Adams, Jr. | |
| 5,921,875 | A | | 7/1999 | Bickel | |

(Continued)

OTHER PUBLICATIONS

Beman Products Catalog, 1999.

(Continued)

*Primary Examiner*—John Ricci
(74) *Attorney, Agent, or Firm*—Holland & Hart

(57) ABSTRACT

The present specification describes novel arrow inserts and arrow systems that may be used for archery. One aspect of the novel arrow inserts relates to two or more separated contact portions or fit rings. The use of at least two fit rings contacting an inside diameter of an arrow shaft at a spaced interval provides better alignment of the arrow insert, and thus an arrow point, with the arrow shaft. The novel arrow inserts may be formed with a lip to limit insertion into the arrow shaft, or without a lip. Inserts without a lip may allow the insert to be fully inserted into the arrow shaft. The inserts may be sized to fit snugly into any arrow shaft, including reduced diameter hunter arrows described herein. The inserts may also be sized to accommodate standard arrow point assemblies, half-out arrow point assemblies, or smaller diameter arrow point assemblies.

30 Claims, 6 Drawing Sheets

U.S. PATENT DOCUMENTS

| | | | | |
|---|---|---|---|---|
| 6,004,300 | A * | 12/1999 | Butcher et al. | 604/222 |
| 6,017,284 | A | 1/2000 | Giles | |
| 6,217,467 | B1 * | 4/2001 | Maleski | 473/583 |
| 6,241,634 | B1 | 6/2001 | Armer, Jr. | |
| 6,251,036 | B1 | 6/2001 | Wu et al. | |
| 6,274,230 | B1 | 8/2001 | Sarrelongue | |
| 6,520,876 | B1 | 2/2003 | Eastman, II | |
| 6,554,726 | B2 | 4/2003 | Thurber | |
| 6,887,172 | B2 * | 5/2005 | Arasmith | 473/583 |
| 6,932,728 | B2 | 8/2005 | Palomaki et al. | |
| 7,004,859 | B2 | 7/2006 | Palomaki et al. | |
| 7,077,770 | B2 | 7/2006 | Palomaki et al. | |
| 7,115,055 | B2 | 10/2006 | Palomaki et al. | |
| 2003/0013565 | A1 | 1/2003 | Song | |
| 2003/0073524 | A1 | 4/2003 | Song | |
| 2003/0104884 | A1 | 6/2003 | Eastman, II | |

OTHER PUBLICATIONS

Game Tracker Catalog, 1998.

Advertisement for Easton P/C All-Carbon Hunting Shaft, date unknown.

Easton Bowhunting and Target Archery Guide, 2004, pp. 4-9, 11-13.

* cited by examiner

ARROW INSERT APPARATUS

TECHNICAL FIELD

This invention relates to arrow systems, including in particular arrow insert systems.

BACKGROUND OF THE INVENTION

Many different types of arrows and arrow shafts are known for use in hunting and sport archery. Several modern arrows comprise assemblies, including a hollow arrow shaft attached to a number of standard components. Traditional arrow shafts usually include some or all of the components shown in FIG. 1. The standard arrow components include inserts 100, points 116 ("point" as used herein means any structure formed at or secured to the forward or distal end of the arrow, including without limitation field points, broadheads, etc.), and nocks 102, all of which are mounted to an arrow shaft 104. It should be noted that fletching, required for proper arrow flight, is not shown in the drawings, but is well understood by those skilled in the art.

The standard insert 100 includes a single fit ring 101. The single fit ring 101 is sized to create a slight interference fit with an inside surface 111 of the arrow shaft 104. The point 116 threads into the insert 100. Therefore, alignment of the point 116 with the arrow shaft 104 is dependent on the single fit ring 101. The single source of alignment provided by the fit ring 101 can make it difficult to precisely align the point 116 with the shaft 104. Therefore, there is a need for arrow systems and inserts that enable better alignment between shafts and points.

SUMMARY OF THE INVENTION

The present invention relates to arrows, arrow assemblies, and arrow inserts. According to some aspects of the invention an apparatus comprising an arrow tip assembly is provided. The arrow tip assembly comprises an insert comprising a first fit ring and a second fit ring spaced from the first fit ring. The insert may comprise a necked down portion disposed between the first fit ring and the second fit ring. A bevel may be disposed in the second fit ring to facilitate insertion of the insert into an arrow shaft.

According to some embodiments, the insert comprises a multi-diameter cylinder. The multi-diameter cylinder includes a first end and a second end, a main body first diameter portion disposed in the first end, a first step up from the first diameter portion to a second diameter portion, the second diameter portion comprising the first fit ring, and a second step up to a third diameter portion, the third diameter portion comprising the second fit ring. The insert may comprise a third step down from the first diameter portion to a fourth diameter portion, the fourth diameter portion spacing the third diameter portion from the first diameter portion. A lip may extend radially outward from the second diameter portion. The lip, first diameter portion, and second diameter portion may comprise the first end, and the third and fourth diameter portions may comprise the second end. The first and second ends may comprise metal or plastic according to some embodiments. According to some embodiments, the first end comprises metal and the second end comprises plastic. The first and second fit rings may be spaced apart by a distance of at least one inch. Moreover, the arrow tip assembly may comprise a point coupled to the insert. The first and second fit rings may comprise an outer diameter sized to fit snugly within an arrow shaft having an inside diameter of 0.200 inches or less. The first and second fit rings may comprise an outer diameter sized to fit snugly within an arrow shaft having an inside diameter of 0.204 inches or greater as well (e.g. an arrow having an inside diameter of 0.245 inches), or a shaft having an inside diameter of 0.187 inches or less.

Another aspect of the invention provides an archery apparatus comprising an arrow insert. The arrow insert comprises a generally cylindrical body having first and second ends. The arrow insert further comprises a first diameter portion having a first diameter and a plurality of glue recesses, a second diameter portion at the first end having a second diameter greater than the first diameter, and a third diameter portion at the second end having a third diameter substantially equal to the second diameter and spaced longitudinally from the second diameter. The longitudinal spacing between the second and third diameters may be at least approximately one inch.

According to some embodiments of the archery apparatus, the generally cylindrical body further comprises a fourth diameter portion having a fourth diameter smaller than the first diameter extending between the first and third diameter portions. The generally cylindrical body may further comprise a radially outward lip ending from the first end at the second diameter portion. The second and third diameter portions may comprise first and second fit rings, respectively, sized to fit snugly against an inner diameter of a hollow arrow shaft. The archery apparatus may comprise any arrow shaft, including, but not limited to, aluminum arrow shafts, carbon composite arrow shaft, and aluminum-carbon composite arrow shafts. The arrow shafts are receptive of the arrow insert and a point threadingly attached to the arrow insert. The point may be a broadhead, a field point, or other point.

According to some embodiments, the archery apparatus further comprises an arrow shaft having an end wall. The arrow insert may be disposed below the end wall of the arrow shaft, with a point threadingly attached to the arrow insert. The point may comprise a shoulder bearing directly against the end wall of the arrow shaft.

Another aspect of the invention comprises an arrow, the arrow comprising a shaft having a first end and a first end wall, and an insert receptive of a point. The insert is at least partially disposed within the first end of the shaft, and the insert comprises a first fit ring, a second fit ring, and a plurality of glue recesses disposed between the first and second fit rings. The insert may further comprising a neck disposed between the first and second fit rings. The insert may comprise a lip bearing against the end wall of the shaft, or the insert may be completely recessed below the end wall of the shaft.

Another aspect of the invention provides a method of coupling a point to an arrow shaft. The method comprises pressing an insert into the arrow shaft. Pressing the insert into the arrow shaft comprises contacting an outer diameter of a first fit ring with an inside diameter of the arrow shaft, and contacting an outer diameter of a second fit ring with the inside diameter of the arrow shaft. The method also includes threading the point to the insert. The method may comprise spacing the first fit ring from the second fit ring. Pressing the point insert into the shaft may comprise inserting the insert below an end wall of the arrow shaft.

Another aspect of the invention provides an apparatus comprising an arrow insert. The arrow insert comprises a cup, and a piston and rod connected to the cup. The rod may interconnect the cup and the piston. The cup and the rod (and the piston) may be hollow, and the cup may be open to the rod. The piston and a portion of the cup may comprise a same outer diameter, while the rod may comprise a smaller diameter.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

DETAILED DESCRIPTION

The present specification describes novel arrow inserts and arrow systems that may be used for archery. One aspect of the novel arrow inserts relates to two or more separated contact portions or fit rings. The use of at least two fit rings contacting an inside diameter of an arrow shaft at a spaced interval provides better alignment of the arrow insert, and thus an arrow point, with the arrow shaft. The novel arrow inserts may be formed with a lip to limit insertion into the arrow shaft, or without a lip. Inserts without a lip may allow the insert to be fully inserted into the arrow shaft. The inserts may be sized to fit snugly into any arrow shaft, including reduced diameter hunter arrows. The inserts may also be sized to accommodate standard arrow point assemblies, half-out arrow point assemblies, or smaller diameter arrow point assemblies.

As used in this specification and the appended claims, the term "neck" means a relatively narrow or constricted part of a structure that joins or connects other parts.

The term "insert" is used broadly to encompass any apparatus that is or may be at least partially introduced into or inside an arrow shaft.

"Hunting arrow" is also used broadly to include any arrows, parts of arrows, or arrow assemblies that are intended specifically for hunting.

"Fiber reinforced polymer (FRP)" refers to any combination of materials of which carbon is one, including without limitation fiber reinforced materials, advanced composites, and other material sets that include only carbon.

As mentioned above, a number of developments in arrow technology, and particularly hunting arrow technology, have recently occurred. While there are many different types of arrow systems and inserts available, conventional arrow systems and arrow inserts have traditionally not provided the level of precision point alignment offered by insert structures in accordance with the present invention. The methods and devices described herein include various inserts and insert assemblies, along with various arrow shafts. However, the particular implementations are exemplary in nature, and not limiting.

Figure 2A:
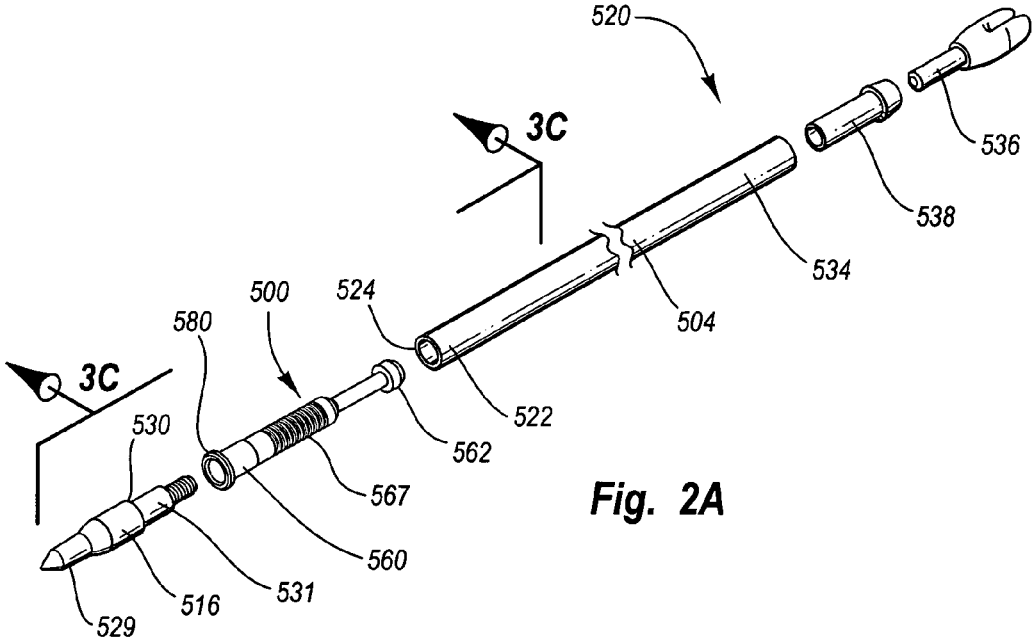
FIG. 2A is an exploded perspective assembly view of an arrow according to one embodiment of the present invention.
Figure 2B:
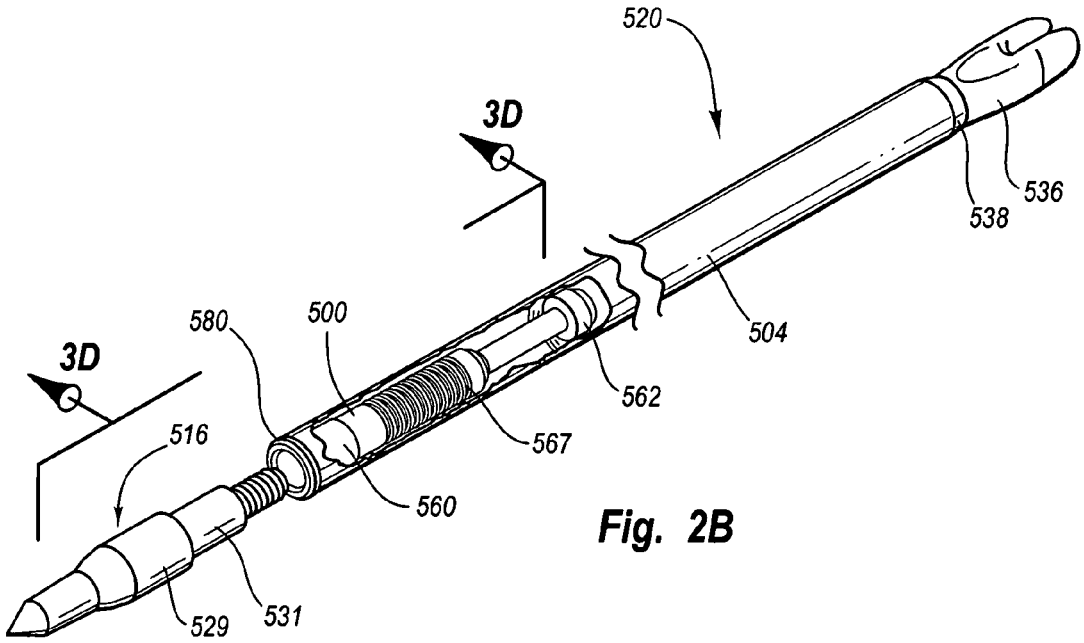
FIG. 2B is a partially assembled, partially cut-away perspective view of the arrow shown in FIG. 2A.
Figure 2C:
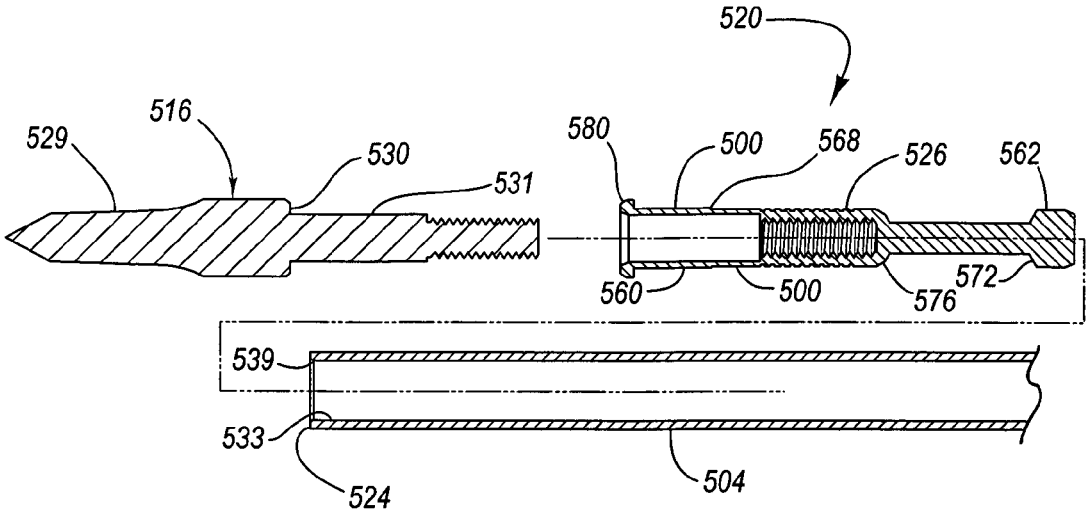
FIG. 2C is an exploded partial sectional side elevation view of an end of the arrow shown in FIG. 2A.
Figure 2D:
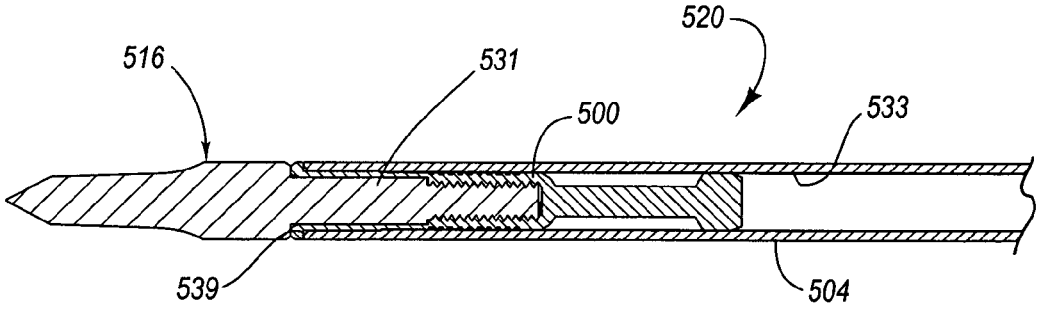
FIG. 2D is a fully assembled, partial sectional side elevation view of the end of the arrow as shown in FIG. 2A.

Turning now to the figures, and in particular to FIGS. 2A-2D, an arrow such as hunting arrow 520 is shown according to one embodiment of the present invention. According to FIGS. 2A-2D, the hunting arrow 520 includes a shaft 504 and an arrow tip assembly. The arrow tip assembly includes an insert 500. The insert 500 is receptive of a point such as a field point 516. The insert 500 is advantageously sized to fit snugly at least partially within the shaft 504 as shown in FIGS. 2B and 2D.

Figure 1:
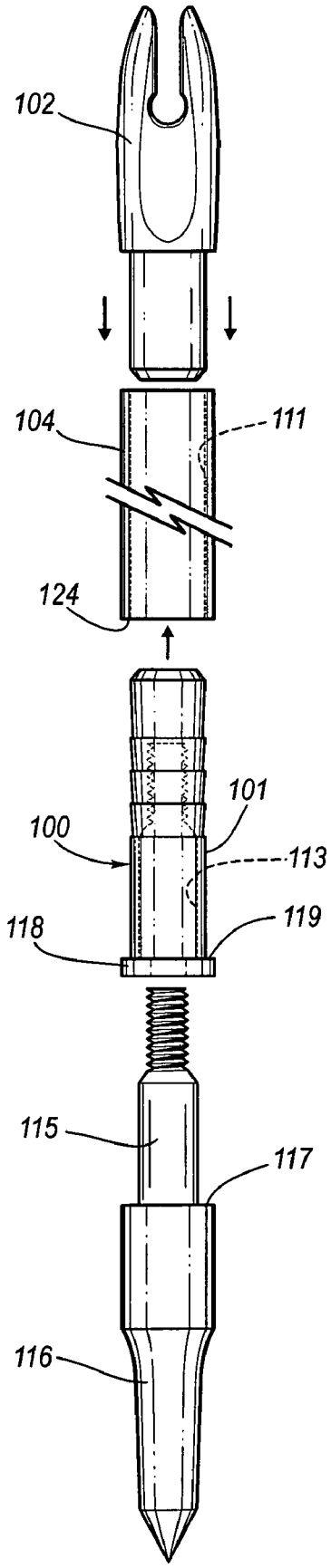
Fig. 1 (Prior Art)
FIG. 1 is a side view of an arrow utilizing inserts according to the prior art.
Figure 3:
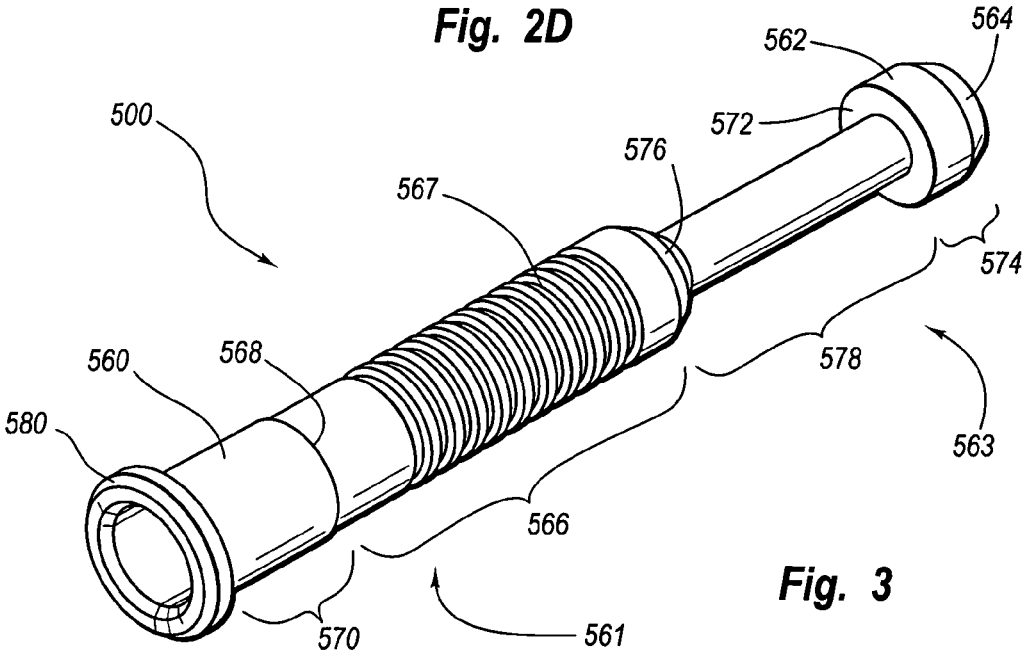
FIG. 3 is a blown up perspective view of the insert shown in FIG. 2A according to one embodiment of the present invention.

The insert 500 is shown in detail in FIG. 3. The insert 500 includes a first fit ring 560 and at least a second fit ring 562 arranged at first and second ends 561, 563, respectively, of the insert 500. The first and second fit rings 560, 562 are longitudinally spaced from one another. According to some embodiments, the first and second fit rings 560, 562 are spaced apart by at least about one inch. However, the first and second fit rings 560, 562 may be spaced by a distance ranging from about a quarter inch to about three inches, according to some embodiments. Each of the first and second fit rings 560, 562 may be sized to create a slight interference fit within an inner diameter or surface 533 of the shaft 504 shown in FIGS. 2A-2D. The first and second fit rings 560, 562 comprise substantially identical outer diameters, and the second fit ring 562 may include a bevel 564 to facilitate insertion of the insert 500 into an arrow shaft. At most, traditional arrow inserts (e.g. insert 100 shown in FIG. 1) include only a single fit ring. Accordingly, alignment of traditional arrow inserts is completely dependent on the single fit ring. However, some embodiments of the present invention provide at least two fit rings, and two fit rings spaced apart more precisely align the insert 500 with the shaft 504 (FIG. 2A). The longer the distance between the first and second fit rings 560, 562, the better the alignment becomes between the insert 500 and the shaft 504 (FIG. 2A).

The insert 500 may comprise a multi-diameter cylinder according to the embodiment shown in FIG. 3. The multi-diameter cylinder includes a main body comprising a first diameter portion 566, which is primarily disposed at the first end 561. The first diameter portion 566 may be sized with a clearance relative to an inner diameter of an arrow shaft. Thus, the first diameter portion 566 may slide freely within an arrow shaft. The first diameter portion 566 may include a plurality of glue recesses 567 that facilitate glued attachment between the insert 500 and the shaft 504 (FIG. 2A). A first step or shoulder 568 up from the first diameter portion 566 begins a second diameter portion 570. The second diameter portion may comprise the first fit ring 560. The shoulder 568 to the second diameter portion 570 may be on the order of only several thousandths of an inch. The outer diameter of the second diameter portion 570 may be sized to fit snugly within an associated arrow shaft such as shaft 504 (FIG. 2A).

Relative to the first diameter portion 566, there may also be a second step 572 up to a third diameter portion 574. The third diameter portion 574 may comprise the second fit ring 562. Therefore, the third diameter portion 574 may comprise the same outer diameter as the second diameter portion 570. However, there may be a third step 576 down to a fourth diameter portion 578. The fourth diameter portion 578 may provide spacing between the first diameter portion 566 and the third diameter portion 574. The fourth diameter portion 578 may comprise a neck or a necked down portion of the first diameter portion 566. The fourth diameter portion 578 may comprise a smaller diameter than the first diameter portion, and may reduce material expense and weight, which is advantageous to arrow performance. Nevertheless, according to some embodiments the fourth diameter portion 578 shown in FIG. 3 may comprise the same diameter as the first or third diameter portions 566, 574.

According to some embodiments, including the embodiment shown in FIG. 3, the first end 561 may include a lip 580 extending radially outward from the second diameter portion 570. The lip 580 may have a diameter similar or identical to the outer diameter of the shaft 504 (FIG. 2A) and may limit the insertion depth of the insert 500 into the shaft 504 (FIG. 2A). The lip 580, the first diameter portion 566, and the second diameter portion 570 may comprise the first end 561. The third and fourth diameter portions 574, 578 may comprise the second end 563. According to some embodiments, the first and second ends 561, 563 each comprise a structural metal material such as aluminum. According to some embodiments, the first end 561 comprises a structural metal material such as aluminum and the second end 563 comprises plastic.

The insert 500 may be substantially hollow as shown in FIGS. 2C and 2D. The first end 561 of the insert 500 is open and may include threading to facilitate attachment to the field point 516 or other point. The second end 563 of the insert 500 may be closed. Therefore, the first end 561 may comprise a cup or elongated cup which may be open at both extents, and the second end 563 may comprise a piston and rod. The cup may include the first and second diameter portions 566, 570. The rod may comprise the fourth diameter portion 578 and may be solid or hollow and may interconnect the cup and the piston. The piston may comprise the third diameter portion 574 and is connected to and/or integral with the cup. The piston may also be solid or hollow and it may be closed as shown in FIG. 3, or it may be open. The piston and cup comprise spaced fit rings that tend to precisely align the insert 500 with the arrow shaft 504 (FIG. 2A) when the insert 500 is pressed into the arrow shaft 504 (FIG. 2A).

Returning to FIGS. 2A-2D, the shaft 504 may comprise any material, including, but not limited to, aluminum, FRP, and aluminum-carbon composite (ACC). The shaft 504 includes a first end 522 and a first end wall 524. The first end wall 524 corresponds to the terminating end of shaft 504. The shaft 504 also includes a second end 534 that is receptive of a nock 536. A nock adapting insert 538 may be included between the shaft 504 and the nock 536. Although FIGS. 2A and 2B show such an insert, it is to be understood that any nock system, such as without limitation, direct fit nock systems (e.g., as shown in FIG. 1), UNI™ bushings with g-nock systems (e.g., as shown in FIG. 2B), and PIN nock systems with PIN nocks, may be used without departing from the scope of the present invention. In addition, a plurality of vanes or other fletching (not shown in the drawings) may be secured to the second end 534 of the shaft.

As mentioned above, the insert 500 is receptive of the point 516. The point 516 may be a standard size, commercially available point. The point 516 includes a head 529 and a shoulder 530 where a relatively greater outside diameter of the point 516 transitions to a shank 531. According to the embodiment of FIGS. 2A-2D, the insert 500 is inserted into the shaft 504 until the lip 580 bears against the end wall 524 of the shaft 504. Therefore, the shoulder 530 of the point 516 bears against the lip 580 and aligns itself with the insert 500 and the shaft 504 as it is threaded into the insert 500.

Another embodiment of the arrow 520 with a different insert 700 is illustrated in FIGS. 4A-4E. The insert 700 is also shown in detail in FIG. 5. Many inserts, including the insert 100 shown in FIG. 1, include a lip 118 that prevents disposing the insert 100 completely within (i.e. recessed inside) the shaft 104. The insert 700 of the embodiment shown in FIGS. 4A-4E and FIG. 5, however, may be fully embedded within the shaft 504. Accordingly, the insert 700 may not include a lip such as the lip 580 shown in the embodiment of FIG. 3. Other than the omission of the lip 580 (FIG. 3), however, the insert 700 may be similar or identical to the insert 500 (FIG. 3). Therefore, the insert 700 includes the first fit ring 560, the second fit ring 562, and the other structures described above with reference to FIGS. 2A-2D and FIG. 3.

The insert 700 is receptive of the point 516. The point 516 is preferably a standard size, commercially available point. The point 516 includes a head 529 and a shoulder 530 where a relatively greater outside diameter of the point 516 transitions to a shank 531. According to the embodiment of FIGS. 4A-4E and FIG. 5, the insert 700 has no lip (e.g., element 118 in FIG. 1) and is inserted below the end wall 524 of the shaft 504. Therefore, the shoulder 530 of the point 516 advantageously bears directly against the end wall or end surface 524 of the shaft 504 as shown in FIGS. 4B, 4D, and 4E. The direct engagement between the shoulder 530 and the end surface 524 according to FIGS. 4A-4E provides a first direct interface location 532 (FIGS. 4D and 4E) between the end wall 524 of the shaft 504 and the shoulder 530 of point 516 which may facilitate a simpler, more precise alignment between the point and the arrow shaft.

A second interface location 537 (FIGS. 4D and 4E) is disposed between the arrow 504 and the point 516. Specifically, the outside surface of the shank 531 of point 516 bears directly against the inside surface 533 of the arrow shaft 504.

In contrast, some arrow systems, including the system shown in FIG. 1, include an extra structural element (i.e., the insert) between the arrow shaft and the point at all locations. Thus, some arrow systems provided at least four (4) different sets of interfacing surfaces, all of which have the potential to affect alignment of the respective parts. One set is located between the shoulder 117 of the point 116 and the outer, flat surface of lip 118 extending from insert 100. Another is located between the bottom surface 119 of lip 118 and the end surface 124 of the arrow shaft 104. Still another set of interfacing surfaces is between the cylindrical outer surface of the insert 100 and the inside surface 111 of the arrow shaft 104. A final set of interfacing surfaces is between the shank 115 on the point 116 and the corresponding inside cylindrical surface 113 of the insert 100.

Thus, arrow systems according to some embodiments of the present invention eliminate two of these sets of interfacing surfaces and provide at least two fit rings to improve the alignment between the point and the arrow shaft. As shown in FIGS. 4C, 4D, and 4E, some embodiments of the present invention provide two spaced fit rings 560, 562 and only two sets of direct interfacing surfaces (interfaces 532 and 537 as shown in detail in FIG. 4E) between the arrow shaft 504 and the point 516 to greatly improve alignment. It is to be understood that while some aspects of the present invention are directed to hunting arrows only, this particular aspect of the present invention applies to all types of arrows, both hunting arrows and target arrows.

Figure 4A:
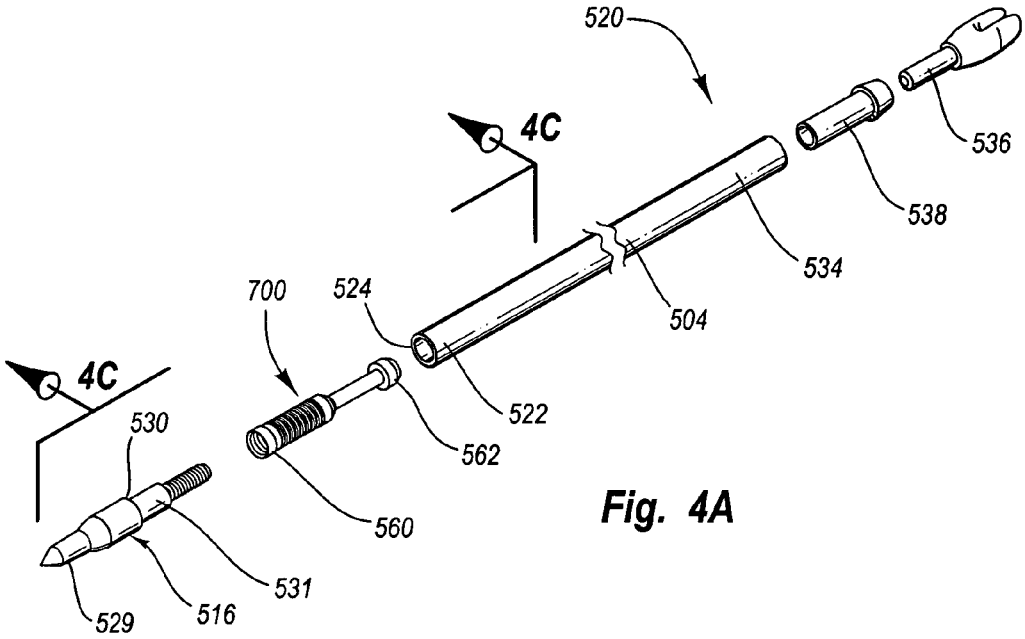
FIG. 4A is an exploded perspective assembly view of an arrow according to another embodiment of the present invention.
Figure 4B:
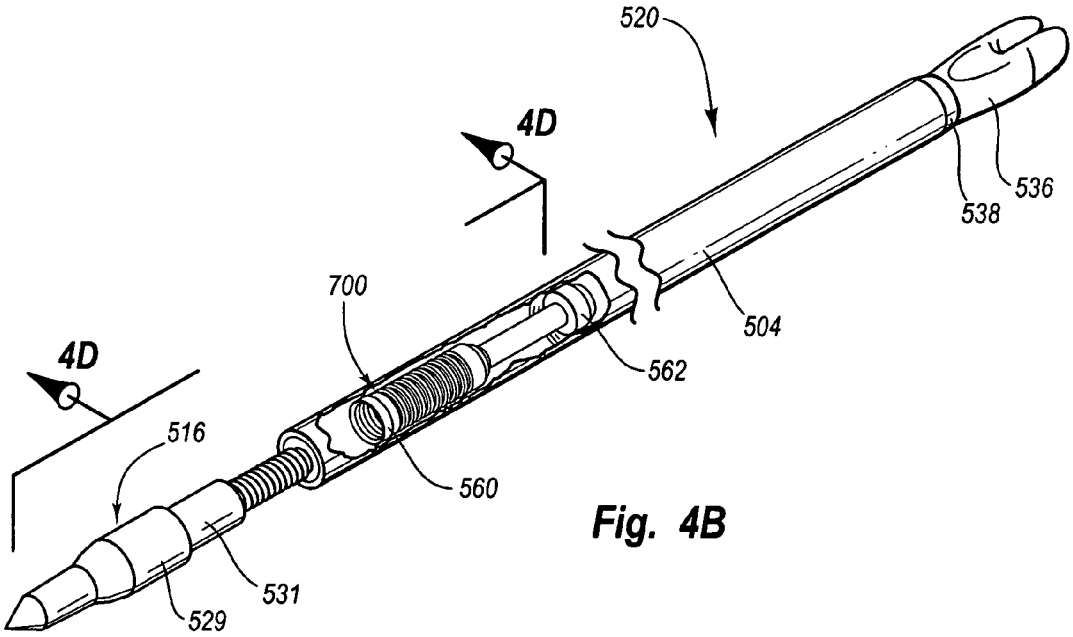
FIG. 4B is a partially assembled perspective view of the arrow shown in FIG. 4A.
Figure 4C:
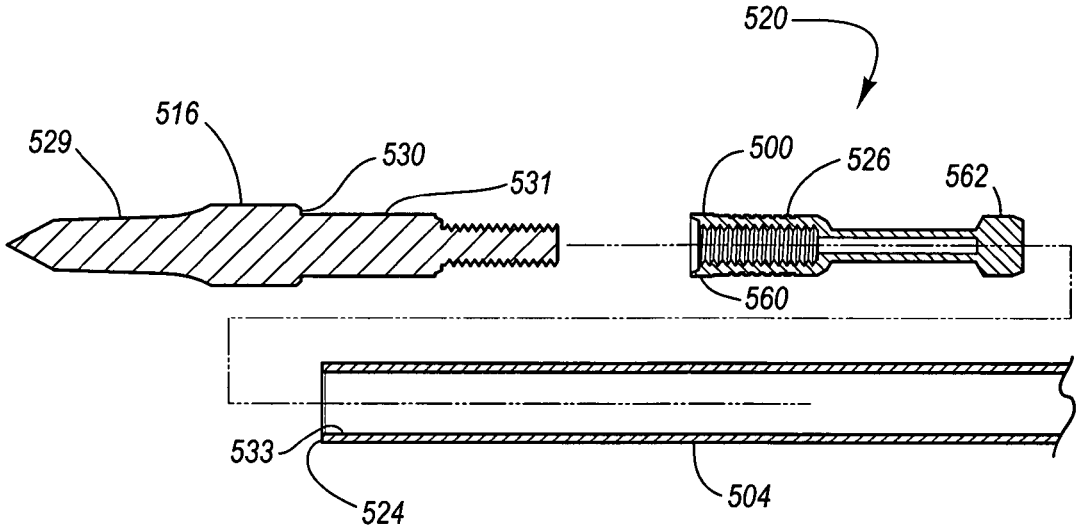
FIG. 4C is an exploded partial sectional side elevation view of an end of the arrow shown in FIG. 4A.
Figure 4D:
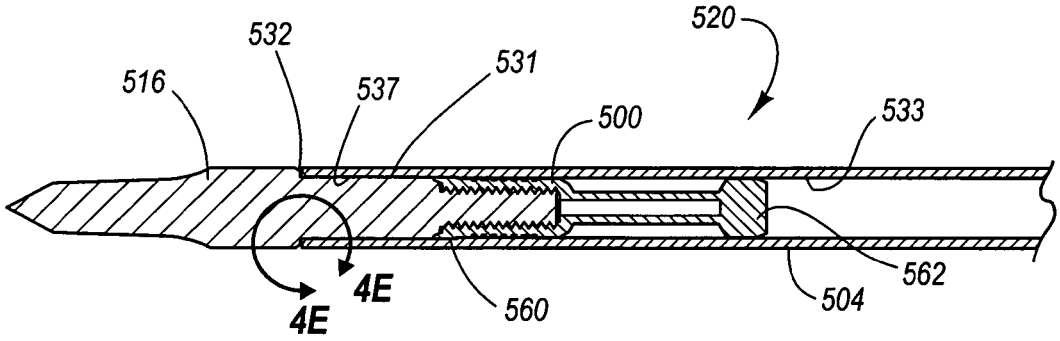
FIG. 4D is a fully assembled, partial sectional side elevation view of the end of the arrow as shown in FIG. 4A.
Figure 4E:
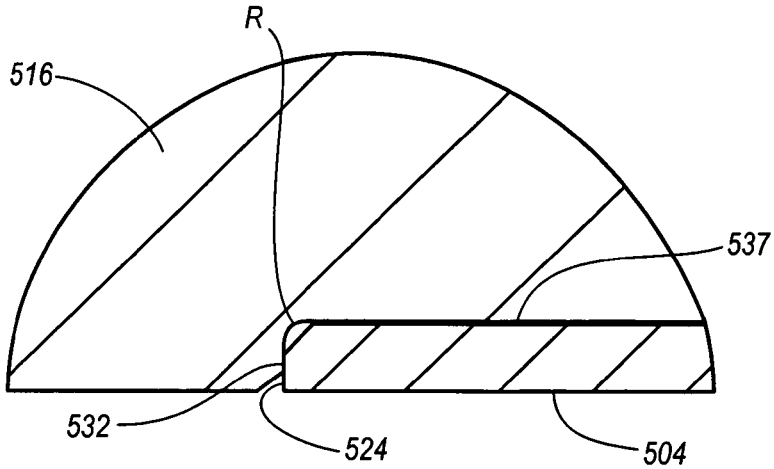
FIG. 4E is a blown up partial cross-sectional view of the end of the arrow along line 4E-4E of FIG. 4D.
Figure 5:
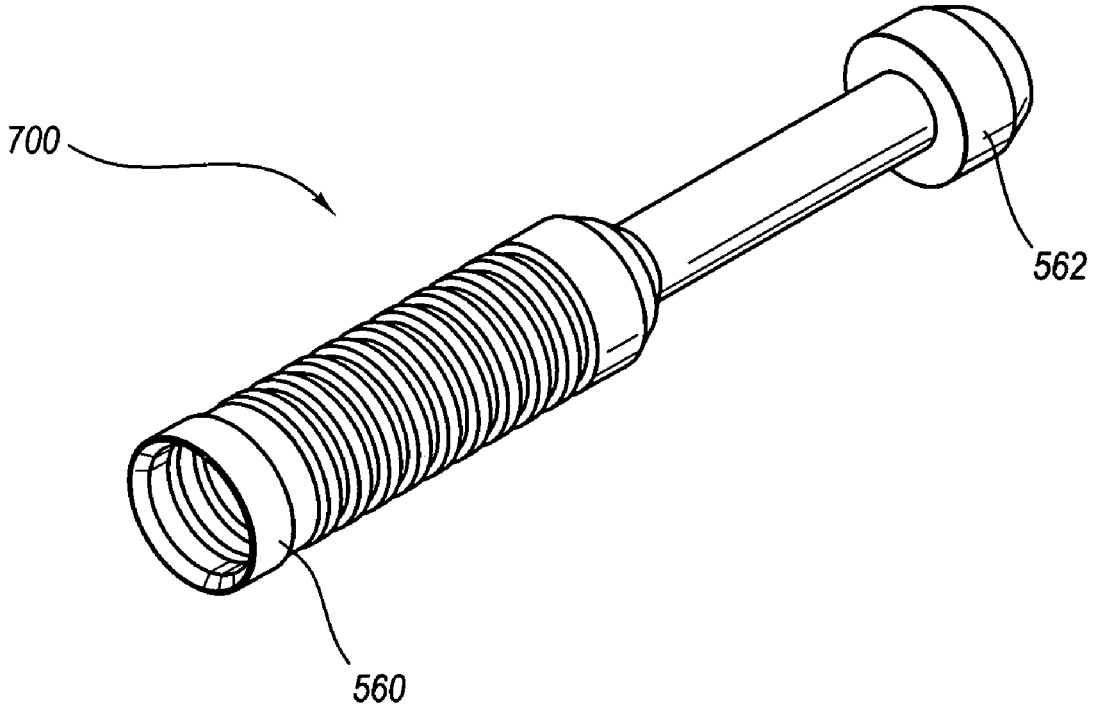
FIG. 5 is a blown up perspective view of the insert shown in FIG. 4A according to one embodiment of the present invention Throughout the drawings, identical reference numbers designate similar, but not necessarily identical, elements.

The insert 700 of FIGS. 4A-4E may be installed or recessed completely within the shaft 504 in a number of ways. One way might be for a user to couple the insert 700 to the point 516 and install both together as a unit. Another way, however, may be to use an insert installation tool (e.g., as shown in U.S. patent application Ser. No. 10/678,821, which is incorporated in its entirety by this reference) to press the insert 700 into the shaft 504 beyond the end wall 524 (FIG. 4A).

The inserts 500/700 described above may be used with any arrow shaft of any size. For example, the arrow shafts may be for hunting or target archery, and may include shafts of any cross-sectional dimensions. The hunting arrows according to principles described herein may therefore include the advantages of a smaller shaft diameter and the convenience of compatibility with standard hunting points.

Nevertheless, the inserts 500/700 may also be used with arrow shafts of reduced or increased diameter, although they may no longer be compatible with standard points. For example, according to some embodiments of the present invention, the inserts 500/700 may be used with arrow shafts having an inside diameter of 0.200 inches, 0.187 inches, or less. New, specially sized points of a diameter and thread different than standard points currently in use may be needed to engage such a specially sized insert.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. An apparatus, comprising:

an arrow tip assembly, the arrow tip assembly comprising:

an arrow point having a shank portion and a head portion, the shank portion having a shank diameter;

an insert into which the arrow point is removably secured, the insert comprising a first fit ring, a second fit ring spaced from the first fit ring, and a necked-down portion disposed between the first and second fit rings, the necked-down portion having a necked-down diameter, the necked-down diameter being less than the shank diameter;

a beveled edge formed on the second fit ring.

2. An apparatus according to claim 1 wherein the insert further comprises:

a multi-diameter cylinder, the multi-diameter cylinder comprising:

a first end and a second end;

a main body first diameter portion disposed in the first end;

a first step up from the first diameter portion to a second diameter portion, the second diameter portion comprising the first fit ring;

a second step up to a third diameter portion, the third diameter portion comprising the second fit ring.

3. An apparatus according to claim 1 wherein the insert further comprises:

a multi-diameter cylinder, the multi-diameter cylinder comprising:

a first end and a second end;

a main body first diameter portion disposed in the first end;

a first step up from the first diameter portion to a second diameter portion, the second diameter portion comprising the first fit ring;

a second step up to a third diameter portion, the third diameter portion comprising the second fit ring;

a third step down from the first diameter portion to a fourth diameter portion, the fourth diameter portion spacing the third diameter portion from the first diameter portion.

4. An apparatus according to claim 1 wherein the insert further comprises:

a multi-diameter cylinder, the multi-diameter cylinder comprising:

a first end and a second end;

a main body first diameter portion;

a first step up from the first diameter portion to a second diameter portion, the second diameter portion comprising the first fit ring;

a lip extending radially outward from second diameter portion;

a second step up to a third diameter portion, the third diameter portion comprising the second fit ring;

a third step down from the first diameter portion to a fourth diameter portion opposite the second diameter portion, the fourth diameter portion spacing the third diameter portion from the first diameter portion;

wherein the lip, first diameter portion, and second diameter portion comprise the first end, and the third and fourth diameter portions comprise the second end.

5. An apparatus according to claim 1 wherein the insert further comprises:

a multi-diameter cylinder, the multi-diameter cylinder comprising:

a first end and a second end;

a main body first diameter portion;

a first step up from the first diameter portion to a second diameter portion, the second diameter portion comprising the first fit ring;

a lip extending radially outward from second diameter portion;

a second step up to a third diameter portion, the third diameter portion comprising the second fit ring;

a third step down from the first diameter portion to a fourth diameter portion opposite the second diameter portion, the fourth diameter portion spacing the third diameter portion from the first diameter portion;

wherein the lip, first diameter portion, and second diameter portion comprise the first end, and the third and fourth diameter portions comprise the second end;

wherein the first end comprises metal and the second end comprises plastic.

6. An apparatus according to claim 1 wherein the first and second fit rings are spaced apart by a distance of at least one inch.

7. An apparatus according to claim 1, further comprising a point coupled to the insert.

8. An apparatus according to claim 1 wherein the first and second fit rings comprise an outer diameter sized to fit snugly within an arrow shaft having an inside diameter of 0.200 inches or less.

9. An archery apparatus, comprising:

an arrow insert, the arrow insert comprising:

a generally cylindrical body having first and second ends, and further comprising:

a first diameter portion having a first diameter and a plurality of glue recesses;

a second diameter portion at the first end having a second diameter greater than the first diameter;

a third diameter portion at the second end having a third diameter substantially equal to the second diameter and spaced longitudinally from the second diameter;

a beveled edge formed on the third diameter portion;

a fourth diameter portion disposed between the second and third diameter portions, the fourth diameter portion having a fourth diameter;

an arrow point having a shank portion and a head portion, the shank portion having a shank diameter, the shank diameter being greater than the fourth diameter.

10. An archery apparatus according to claim 9 wherein the fourth diameter is smaller than the first diameter.

11. An archery apparatus according to claim 9 wherein the generally cylindrical body further comprises a radially outward lip ending from the first end at the second diameter portion.

12. An archery apparatus according to claim 9 wherein second and third diameter portions comprise first and second fit rings, respectively, sized to fit snugly against an inner diameter of a hollow arrow shaft.

13. An archery apparatus according to claim 9, further comprising a carbon composite arrow shaft receptive of the arrow insert, and the arrow point is threadingly attached to the arrow insert.

14. An archery apparatus according to claim 9, further comprising an arrow shaft comprising an end wall;

wherein the arrow insert is disposed completely within and below the end wall of the arrow shaft, wherein the arrow point is threadingly attached to the arrow insert, the arrow point comprising a shoulder bearing directly against the end wall of the arrow shaft.

15. An apparatus according to claim 9 wherein the second and third diameter portions each comprise an outer diameter sized to fit snugly within an arrow shaft having an inside diameter of 0.200 inches or less.

16. An archery apparatus according to claim 9 wherein the first end comprises metal and the second end comprises plastic.

17. An archery apparatus according to claim 9 wherein a longitudinal spacing between the second and third diameters is at least approximately one inch.

18. An arrow, comprising:

a shaft having a first end and a first end wall;

an arrow point having a shank portion and a head portion, the shank portion having a shank diameter;

an insert receptive of the arrow point, the insert at least partially disposed within the first end of the shaft, the insert comprising:

a first fit ring;

a second fit ring;

a plurality of glue recesses disposed between the first and second fit rings;

a bevel disposed on the second fit ring;

a necked-down portion disposed between the first and second fit rings, the necked-down portion having a necked-down diameter, the necked-down diameter being less than the shank diameter.

19. An arrow according to claim 18, further comprising a neck disposed between the first and second fit rings.

20. An arrow according to claim 18 wherein the insert is completely disposed below the end wall of the shaft.

21. An arrow according to claim 18 wherein the first and second fit rings are separated by at least about one inch.

22. A method of coupling a point to an arrow shaft, comprising:

pressing an insert into the arrow shaft;

wherein the pressing the insert into the arrow shaft comprises contacting an outer diameter of a first fit ring with an inside diameter of the arrow shaft and contacting an outer diameter of a second fit ring with the inside diameter of the arrow shaft wherein the second fit ring comprises a beveled edge, the insert including a necked-down portion disposed between the first and second fit rings, the necked-down portion having a necked-down diameter;

threading the point to the insert;

wherein the threading the point into the insert comprises inserting a shank portion of the point into engagement with the insert, the shank portion having a shank diameter, the shank diameter being greater than the necked-down diameter.

23. A method of coupling a point to an arrow shaft according to claim 22, further comprising spacing the first fit ring from the second fit ring.

24. A method of coupling a point to an arrow shaft according to claim 22 wherein the pressing the point insert into the shaft comprises inserting the insert below an end wall of the arrow shaft.

25. An apparatus, comprising:

an arrow insert, the arrow insert comprising:

a cup;

a piston and rod connected to the cup, the rod having a rod diameter;

a beveled edge formed on the piston;

an arrow point having a shank portion and a head portion, the shank portion having a shank diameter, the shank diameter being greater than the rod diameter.

26. The apparatus of claim 25, wherein the rod interconnects the cup and the piston.

27. The apparatus of claim 25 wherein the cup and the rod are hollow, and the cup is open to the rod, and wherein the piston and a portion of the cup comprise a same diameter.

28. An arrow tip assembly comprising:

an arrow insert comprising:

a first fit ring dimensioned to fit snugly against an inside surface of an arrow shaft;

a second fit ring dimensioned to fit snugly against the inside surface of the arrow shaft;

a stepped-down portion separating the first fit ring from the second fit ring, the stepped-down portin having a stepped-down diameter;

a beveled edge formed on the second fit ring;

an arrow point removably secured to the arrow insert, the arrow point having a head portion and a shank portion, the shank portion having a shank diameter, the shank diameter being greater than the stepped-down diameter.

29. An arrow tip assembly comprising:

a fitting portion, the fitting portion comprising:

a first fit ring;

a second fit ring;

a rod connecting the first and second fit rings, the rod having a rod diameter;

an elongate-tube-shaped gap formed between the first and second fit rings and around the rod;

a beveled edge formed on the second fit ring;

an arrow point secured to the fitting portion, the arrow point having a head portion and a shank portion, the shank portion having a shank diameter, the shank diameter being greater than the rod diameter.

30. An arrow tip assembly comprising:

a dumbbell-shaped fitting portion comprising:

a first end;

a second end;

a bar connecting the first end to the second end, the bar having a bar diameter;

a beveled edge formed on the second end;

an arrow point secured to the fitting portion, the arrow point having a head portion and a shank portion, the shank portion having a shank diameter, the shank diameter being greater than the bar diameter.

* * * * *